US008221168B2

(12) United States Patent
Neureiter

(10) Patent No.: US 8,221,168 B2
(45) Date of Patent: Jul. 17, 2012

(54) PLUG CONNECTOR FOR A STAR QUAD CABLE

(75) Inventor: Franz Josef Neureiter, Haigermoos (AT)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 13/129,137

(22) PCT Filed: Oct. 29, 2009

(86) PCT No.: PCT/EP2009/007757

§ 371 (c)(1), (2), (4) Date: May 13, 2011

(87) PCT Pub. No.: WO2010/054751

PCT Pub. Date: May 20, 2010

(65) Prior Publication Data

US 2011/0217881 A1 Sep. 8, 2011

(30) Foreign Application Priority Data

Nov. 13, 2008 (DE) ..... 20 2008 015 045 U

(51) Int. Cl.
*H01R 13/04* (2006.01)

(52) U.S. Cl. ..... 439/692; 439/862

(58) Field of Classification Search ..... 439/350, 439/374, 572, 660, 675, 680, 692, 695, 751, 439/816, 861, 862

See application file for complete search history.

(56) References Cited

U.S. PATENT DOCUMENTS

| | | | | |
|---|---|---|---|---|
| 4,036,544 | A * | 7/1977 | Keglewitsch | 439/350 |
| 4,281,888 | A * | 8/1981 | Seaman | 439/692 |
| 5,413,506 | A * | 5/1995 | Thompson | 439/660 |

FOREIGN PATENT DOCUMENTS

| | | | |
|---|---|---|---|
| DE | 2902737 | A1 | 8/1980 |
| EP | 1401056 | A1 | 3/2004 |
| EP | 1422791 | A1 | 5/2004 |

* cited by examiner

*Primary Examiner* — Kheim Nguyen

(74) *Attorney, Agent, or Firm* — DeLio & Peterson, LLC; Robert Curcio

(57) ABSTRACT

A plug connector for a cable having at least two signal conductors, in particular a star quad cable, having a signal conductor part and an insulating part which holds the signal conductor part. The signal conductor part has a spring lug, electrically and mechanically connected to a signal conductor, wherein the insulating part has an axial hole and a spring lug passes through each of said axial holes, wherein the holes are arranged to hold the spring lugs at a physical distance from one another. The spring lugs project beyond the insulating part at the plugging-side end and are bent over in such a way that the respective bent-over portions of the spring lugs run from the plugging-side end in the direction of the cable-side end on an outer face of the insulating part and can be resiliently elastically deformed in the radial direction.

11 Claims, 6 Drawing Sheets

PLUG CONNECTOR FOR A STAR QUAD CABLE

This application is a National Stage filing based on PCT/EP2009/007757, filed Oct. 29, 2009, and which claims priority to German Patent Application No. DE 20 2008 015 045.0, filed Nov. 13, 2008.

BACKGROUND OF THE INVENTION

Field of the Invention

The present invention relates to a plug connector for a cable having at least two signal conductors, in particular four signal conductors, in particular for a star quad cable, having a signal conductor part and an insulating part which holds the signal conductor part, wherein the plug connector has a plugging-side end for plug-connection to a complementary plug connector, and a cable-side end for electrical and mechanical connection to the cable. The invention further relates to a plug connector arrangement comprising a plug connector and a complementary mating plug connector, wherein the plug connector is formed as described above and the mating plug connector has a number of contact elements corresponding to the number of spring lugs.

SUMMARY OF THE INVENTION

Bearing in mind the problems and deficiencies of the prior art, it is an object underlying the invention to improve a plug connector with regard to electrical characteristics and installation space requirement.

This object is achieved according to the invention by a plug connector of the aforementioned type. Advantageous embodiments of the invention are described in the claims.

The above and other objects, which will be apparent to those skilled in the art, are achieved in the present invention which is directed to a plug connector for a cable including at least two signal conductors, the plug connector comprising a signal conductor part and an insulating part which holds the signal conductor part, wherein the plug connector has a plugging-side end for plug-connection to a complementary plug connector, and a cable-side end for electrical and mechanical connection to the cable, wherein the signal conductor part for each signal conductor includes a spring lug electrically and mechanically connected to a signal conductor, wherein the insulating part for each spring lug includes an axial hole through which a spring lug passes, wherein the holes hold the spring lugs at a physical distance from one another, this distance corresponding to the distance between the signal conductors in the cable, the spring lugs formed such that they are longer than the insulating part in the axial direction, and project beyond the insulating part at the plugging-side end are bent over such that the bent-over portions of the spring lugs run from the plugging-side end in the direction of the cable-side end and on an outer face of the insulating part can be resiliently elastically deformed in the radial direction.

The plug connector includes a number of grooves on the insulating part outer face running in the axial direction corresponding to the number of spring lugs, wherein the grooves are arranged and formed such that in each case a bent-over portion of a spring lug is arranged in one of the grooves.

The holes in the insulating part hold the spring lugs in a spatial position which corresponds to the arrangement of the signal conductors relative to one another in the cable. The spring lugs are crimped onto ends of the signal conductors of the cable.

The plug connector may include a supporting sleeve which grips the cable at the cable-side end of the plug connector. The supporting sleeve may be crimped onto the cable.

In a second aspect, the present invention is directed to a plug connector arrangement comprising a plug connector and a complementary mating plug connector, wherein the plug connector is formed in accordance with claim 1 and the mating plug connector includes a number of contact elements corresponding to the number of spring lugs, such that the mating plug connector includes an insulating part in the form of a socket, the inner face of which is formed in a complementary manner to the outer face of the insulating part of the plug connector, the insulating part of the plug connector adapted for plugging axially into the socket of the mating plug connector, wherein the contact elements on the inner face of the socket of the mating plug connector are arranged in such a way that when the plug connector and mating plug connector are plugged together, each contact element of the mating plug connector is in electrical contact with a spring lug of the plug connector.

On its outer face, the insulating part of the plug connector may include a number of grooves running in the axial direction corresponding to the number of spring lugs, the grooves receiving a bent-over portion of a spring lug, wherein the socket of the mating plug connector has radial ridges on its inner face which are arranged and may be formed in such a way that when the plug connector and mating plug connector are plugged together axially, each radial ridge engages in a groove on the outer face of the insulating part of the plug connector, wherein a contact element of the mating plug connector is arranged on each ridge of the socket.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
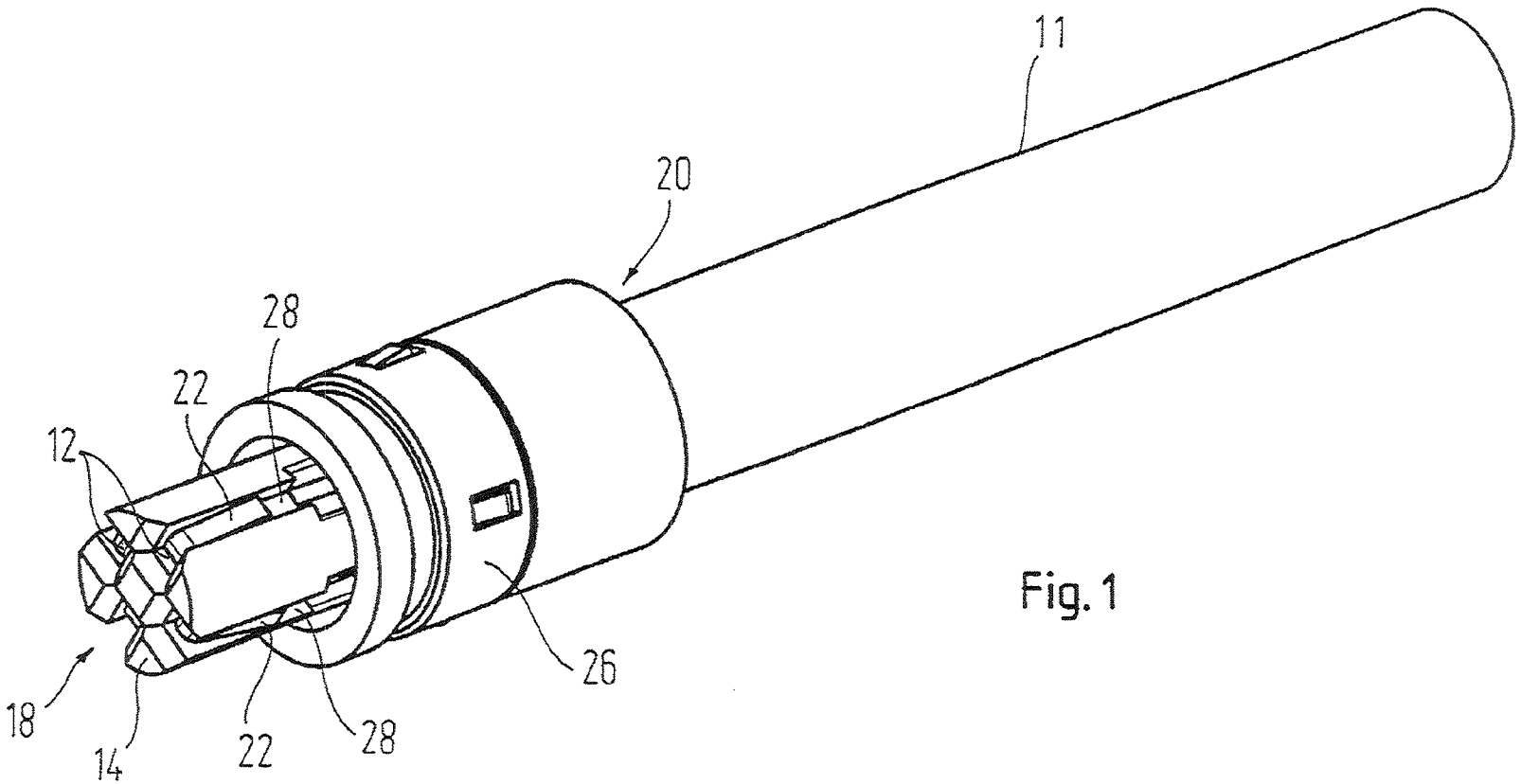
FIG. 1 shows a preferred embodiment of a plug connector according to the invention with cable in a perspective sectional view.

In describing the preferred embodiment of the present invention, reference will be made herein to FIGS. 1-6 of the drawings in which like numerals refer to like features of the invention.

A star quad cable is a symmetrical copper cable. In this cable four cores are stranded together in a cruciform arrangement. This means that the opposing cores each form a core pair. Very little crosstalk occurs owing to the perpendicularly arranged wire pairs.

The construction of the star quad must be stable so that the cores do not move during installation, since this would change the transmission characteristics. For that reason supporting and stabilizing elements are sometimes additionally used in star quads so as not to change the optimal position of the cores.

The substantial advantage of star quad stranding is the greater packing density as compared with pair stranding.

In a plug connector of the aforementioned type it is provided according to the invention that the signal conductor part for each signal conductor has a spring lug which is electrically and mechanically connected to a signal conductor, wherein the insulating part for each spring lug has an axial hole through which a spring lug passes, wherein the holes are arranged and formed in such a way that the holes hold the spring lugs at a physical distance from one another, this distance corresponding to the distance between the signal conductors in the cable, wherein the spring lugs are formed in such a way that they are longer than the insulating part in the axial direction, wherein the spring lugs project beyond the insulating part at the plugging-side end and are bent over in such a way that the bent-over portions of the spring lugs run from the plugging-side end in the direction of the cable-side end on an outer face of the insulating part and can be resiliently elastically deformed in the radial direction.

This has the advantage that an easy-to-install and at the same time electrically high-quality plug connector is available which has a particularly small installation space requirement and is suitable for high-frequency applications.

An axial routing with precise spatial orientation of contact conductors of a complementary plug connector and the bent-over portions of the spring lugs is achieved in that on its outer face the insulating part has a number of grooves running in the axial direction corresponding to the number of spring lugs, wherein the grooves are arranged and formed in such a way that in each case a bent-over portion of a spring lug is arranged in one of the grooves.

In a preferred embodiment the holes in the insulating part are arranged and formed in such a way that the holes hold the spring lugs in a spatial position which corresponds to the arrangement of the signal conductors relative to one another in the cable.

A particularly good electrical and mechanical connection between the signal conductors and the spring lugs is achieved by crimping the spring lugs onto ends of the signal conductors of the cable.

A mechanically particularly stable and resistant plug connector is obtained by additionally providing a supporting sleeve which grips the cable at the cable-side end of the plug connector. The supporting sleeve is crimped onto the cable for example.

In a plug connector arrangement of the aforementioned type it is provided according to the invention that the mating plug connector has an insulating part in the form of a socket, the inner face of which is formed in a complementary manner to the outer face of the insulating part of the plug connector in such a way that the insulating part of the plug connector can be plugged axially into the socket of the mating plug connector, wherein the contact elements on the inner face of the socket of the mating plug connector are arranged in such a way that when the plug connector and mating plug connector are plugged together, each contact element of the mating plug connector is in electrical contact with a spring lug of the plug connector.

This has the advantage that a plug connector arrangement is provided which has a particularly small installation space requirement and is suitable for high-frequency applications.

An axial electrical sliding contact between the plug connector and the mating plug connector with axial tolerance compensation is achieved in that on its outer face the insulating part of the plug connector has a number of grooves running in the axial direction corresponding to the number of spring lugs, wherein the grooves are arranged and formed in such a way that in each case a bent-over portion of a spring lug is arranged in one of the grooves, wherein the socket of the mating plug connector has radial ridges on its inner face which are arranged and formed in such a way that when the plug connector and mating plug connector are plugged together axially, each radial ridge engages in a groove on the outer face of the insulating part of the plug connector, wherein a contact element of the mating plug connector is arranged on each ridge of the socket. The necessary contact force for the electrical contact between each spring lug and contact element is made available by the resiliently elastic, bent-over portions of the spring lugs in the grooves of the insulating part of the plug connector.

In a preferred embodiment the radial ridges of the socket of the mating plug connector are formed by the contact elements, which are arranged in grooves on the inner face of the socket of the mating plug connector.

Figure 6:
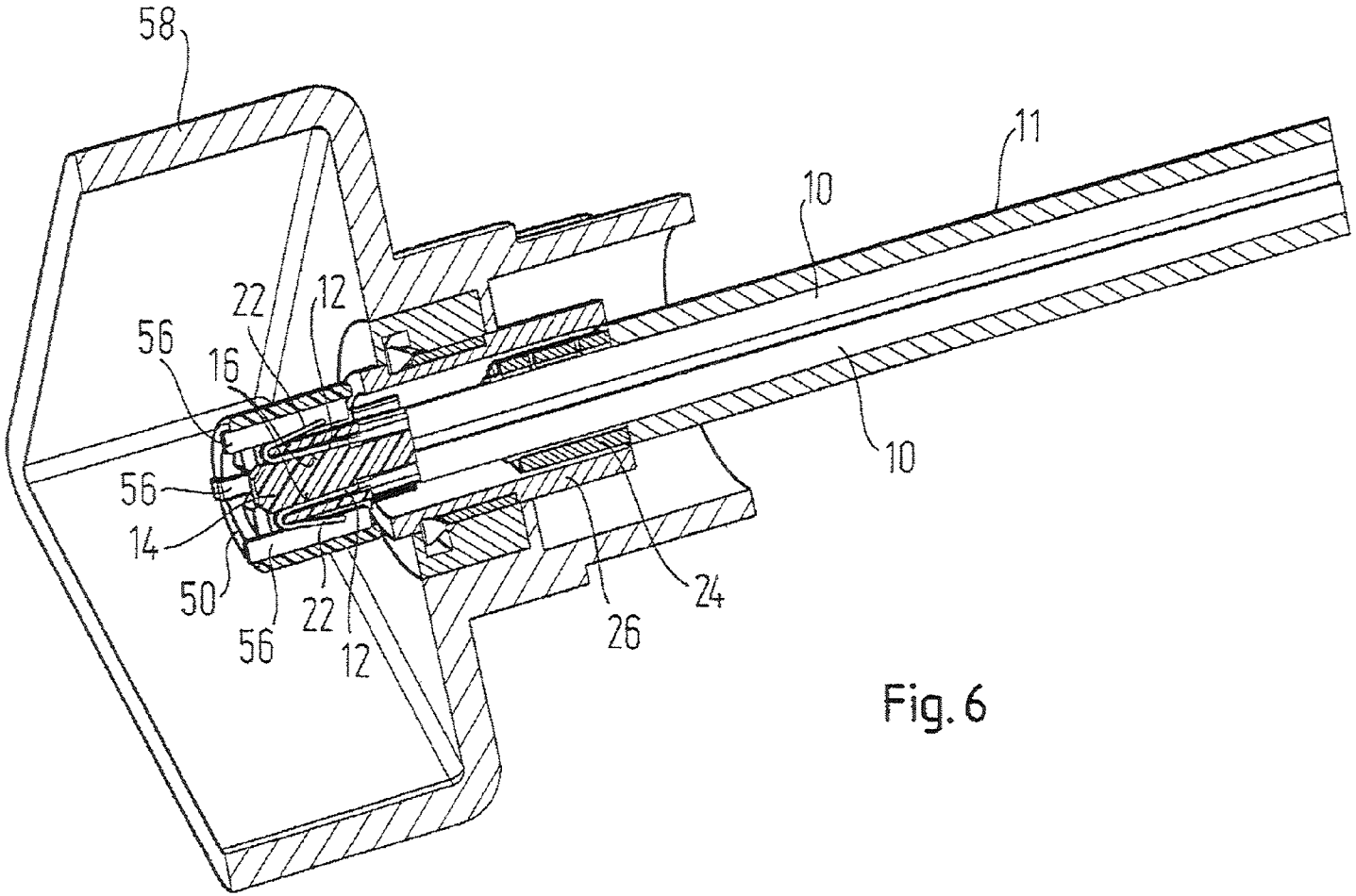
FIG. 6 shows a preferred embodiment of a plugging arrangement according to the invention with a socket as shown in FIG. 5 in the plugged-in state in a perspective, sectional view.

The preferred embodiment of a plug connector according to the invention shown in FIGS. 1 to 4 and 6 is designed for connection to a star quad cable 11 having four signal conductors 10 at a cable-side end 20 and furthermore has a plugging-side end 18 for plug-connection to a complementary plug connector (FIG. 6). As can be seen from FIG. 2 in particular, a spring lug 12 is crimped onto each signal conductor 10, wherein all four spring lugs 12 together form a signal conductor part of the plug connector. The plug connector furthermore includes an insulating part 14, which has four holes 16 extending in the axial direction. Each spring lug 12 passes through one of the holes 16 and is longer than the insulating part 14 in the axial direction. The ends of the spring lugs 12 projecting beyond the insulating part 14 at the plugging-side end 18 of the insulating part 14 (see FIG. 3) are bent over and on an outer face of the insulating part 14 are directed back towards the cable-side end 20 and form bent-over portions 22 of the spring lugs 12. These bent-over portions 22 are formed to be resiliently elastically deformable.

Figure 2:
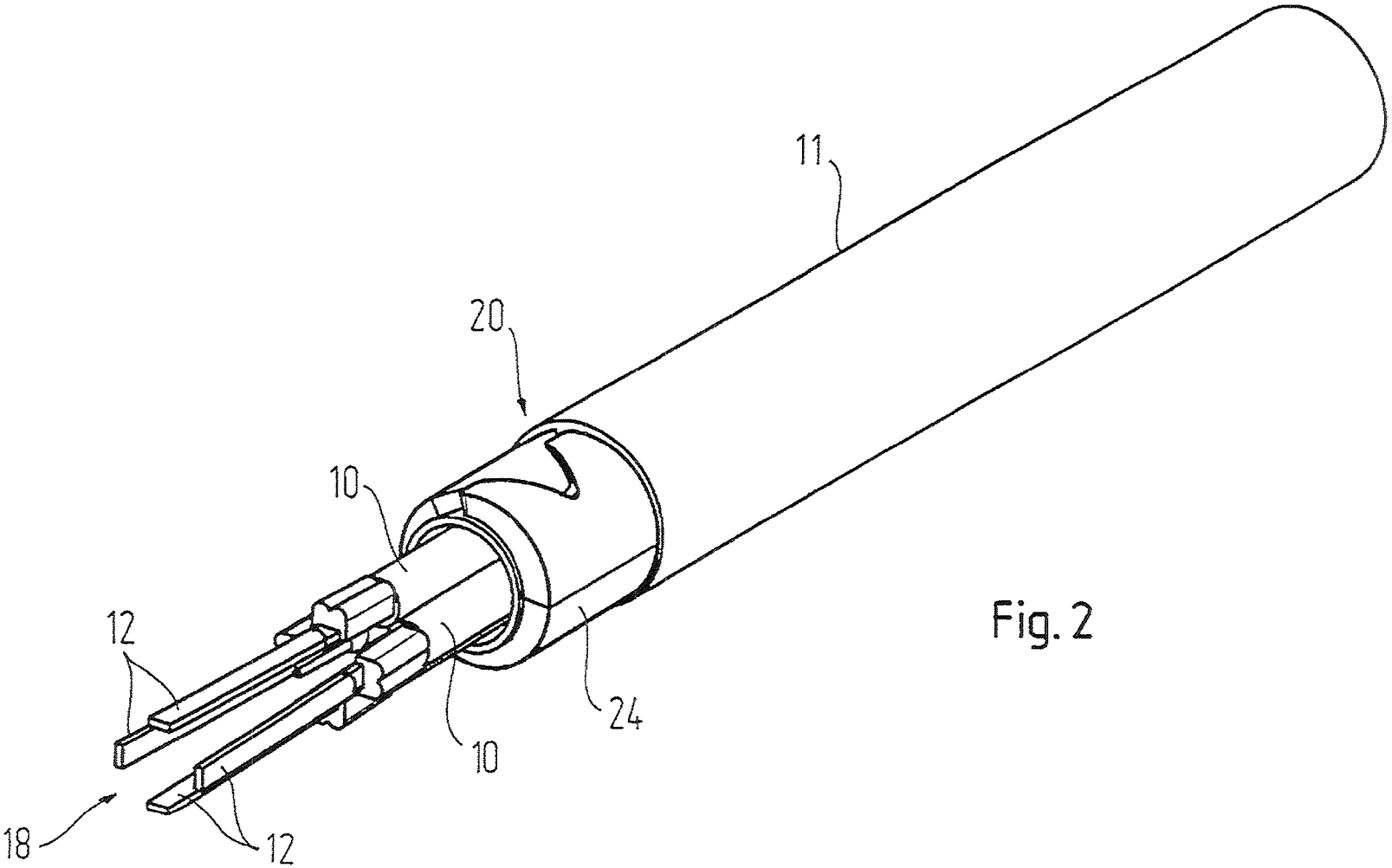
FIG. 2 shows a cable end prepared for mounting of the plug connector as shown in FIG. 1 after a first mounting step with the mounted signal conductor part and mounted supporting sleeve.
Figure 3:
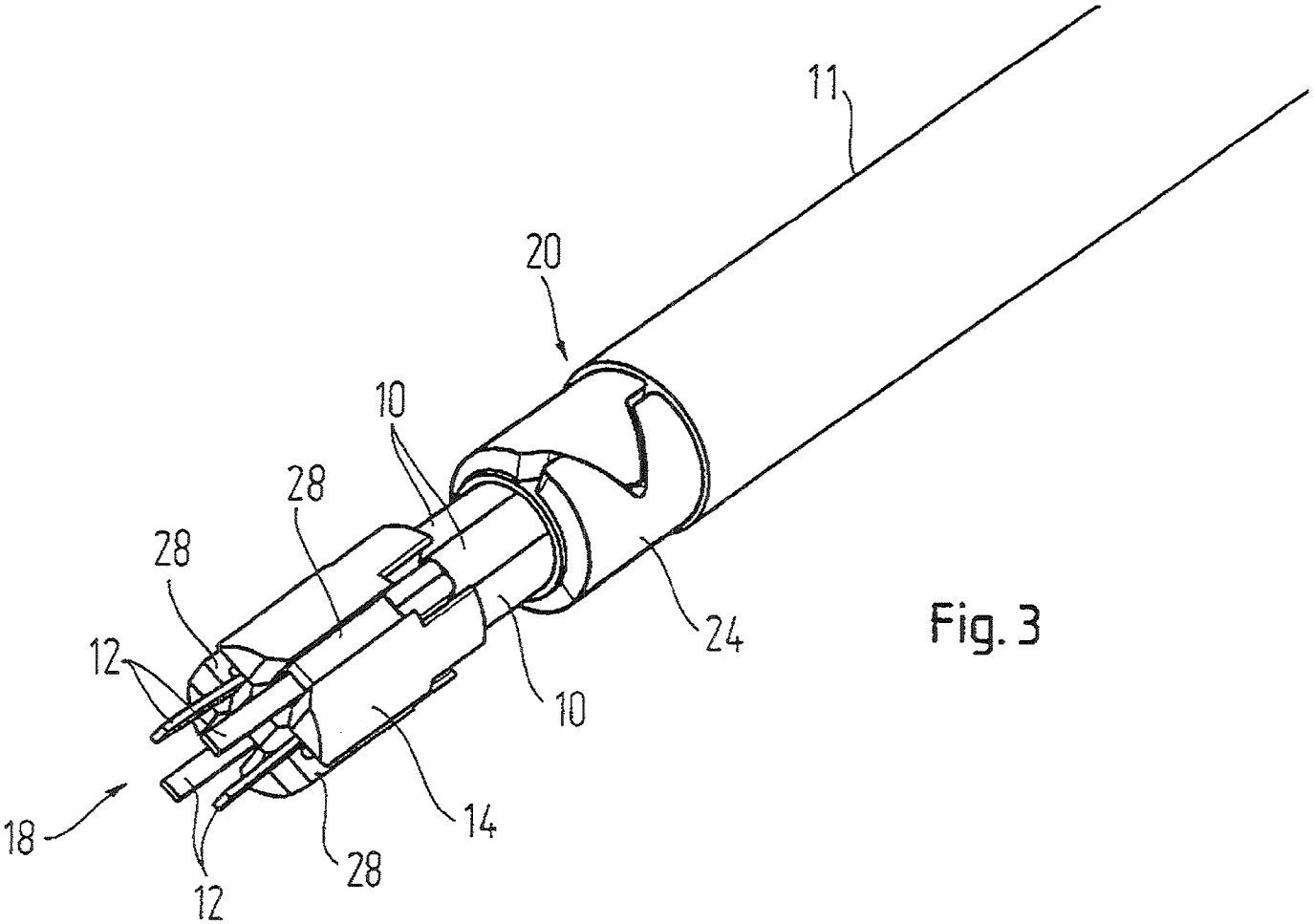
FIG. 3 shows the cable end as shown in FIG. 2 after a second mounting step with the additionally mounted insulating part.
Figure 4:
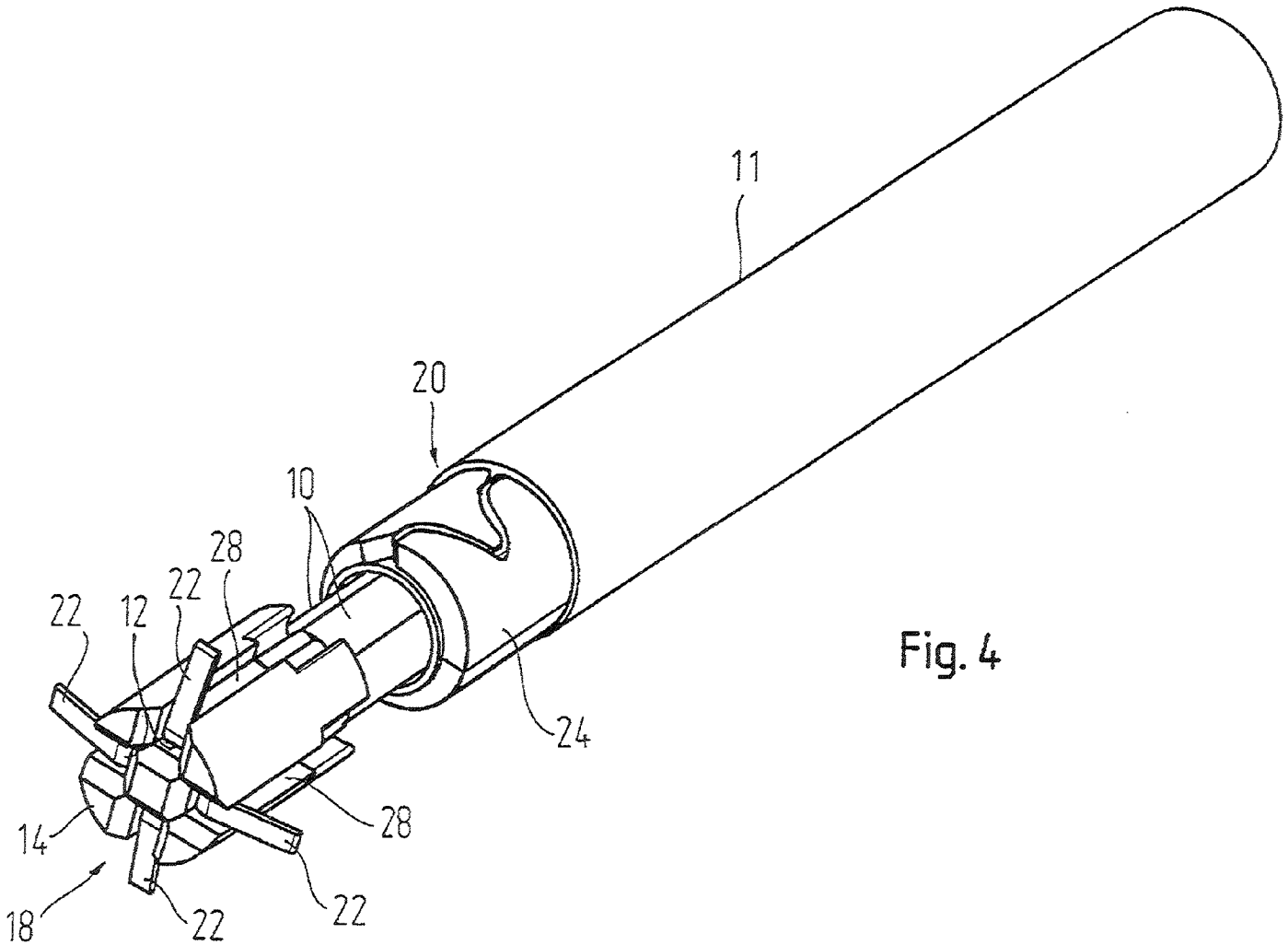
FIG. 4 shows the cable end as shown in FIG. 2 after a third mounting step with partially bent-over spring lugs.
Figure 5:
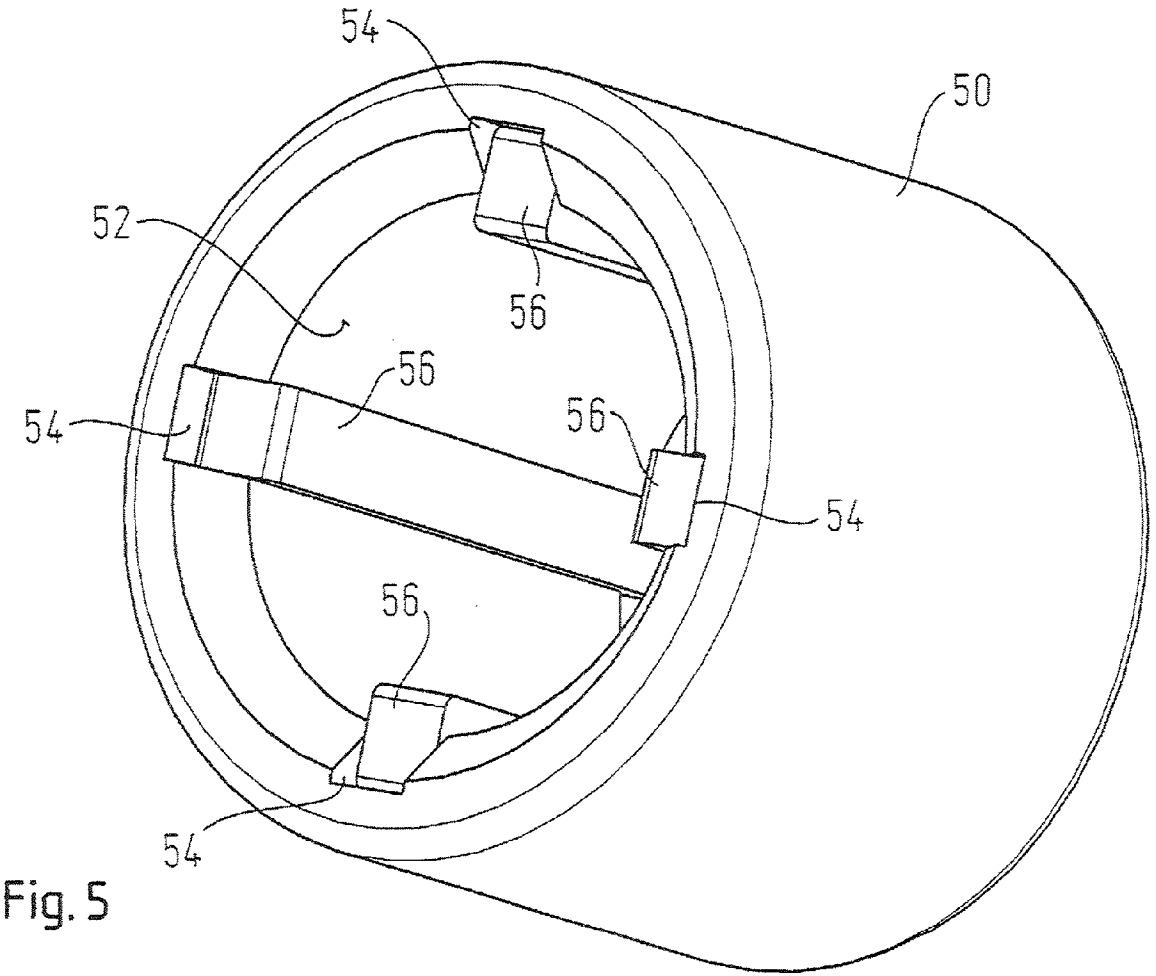
FIG. 5 shows a preferred embodiment of an insulating part of a mating plug connector of a plugging arrangement according to the invention in a perspective view.

A plurality of mounting steps for mounting the plug connector according to the invention on the cable 11 is shown in FIGS. 2 to 4. First, cable 11 is stripped and a supporting sleeve 24 is crimped onto it. Furthermore, spring lugs 12 of the signal conductor part of the plug connector are crimped onto ends of the signal conductors 10. After these mounting operations the mounting progress is in the state shown in FIG. 2. Then the insulating part 14 is slipped on such that each spring lug 12 extends through one of the holes 16 of the insulating part 14. At the plugging-side end 18 the spring lugs 12 project out of the insulating part 14 in the axial direction. These projecting portions become the bent-over portions 22 of the spring lugs 12. After these mounting operations the mounting progress is in the state shown in FIG. 3. Now the projecting portions 22 of the spring lugs 12 are bent over as shown in FIG. 4. Then the projecting portions 22 are bent over further until these portions 22 on the outer face of the insulating part 14 run back in the direction of the cable-side end 20, such that the projecting portions 22 become the bent-over portions 22 of the spring lugs 12. These bent-over portions 22 do not run exactly parallel to the outer face of the insulating part 14 but rather lift up outwards in the radial direction. Four grooves 28 are formed on the outer face of the insulating part 14 to accommodate the bent-over portions 22 of the spring lugs 12. Owing to their resiliently elastic deformability the bent-over portions 22 of the spring lugs 12 can be bent inwards in the radial direction. In this way it is possible for electrical contact to be made via the bent-over portions 22 of the spring lugs 12 with corresponding contact elements of a complementary plug connector or mating plug connector, as shown in FIG. 5, wherein the contact area necessary for an electrical contact arises with the corresponding contact pressure. Furthermore an outer conductor part 26 is crimped onto the supporting sleeve 24. This outer conductor part 26 has a latching function to retain a casing 58 (FIG. 6) of the mating plug connector. The outer conductor part 26 furthermore has a spring lug for an electrical contact with the corresponding outer conductor contact of the mating plug connector. At the end of these final mounting steps the plug connector is mounted on the cable 11 ready for use, as shown in FIG. 1.

FIG. 5 shows by way of example an embodiment of an insulating part 50 of a mating plug connector for plug-connection to a plug connector according to FIGS. 1 to 4. This insulating part 50 is formed as a socket which on an inner wall 52 has grooves 54 extending in the axial direction. An internal diameter of the socket is formed in such a way that the insulating part 14 of the plug connector according to FIGS. 1 to 4 can be plugged into the socket 50 of the mating plug connector. The grooves 54 are arranged in such a way that when the plug connector and the mating plug connector are oriented appropriately to each other they align with the grooves 28 of the insulating part 14 of the plug connector according to FIGS. 1 to 4. In each of the grooves 54 of the socket 50 a contact element 56 is arranged which projects inside the grooves 54 in the radial direction. In this way when the plug connector according to FIGS. 1 to 4 is plugged into a mating plug connector the contact elements 56 engage in the grooves 28 of the insulating part 14 of the plug connector and establish an electrical contact with the bent-over portions 22 of the spring lugs 12.

The plugged-in state of the plug connector and mating plug connector is shown in FIG. 6. The mating plug connector has a casing 58. For reasons of clarity the continuation of the signal conductors beyond the contact elements 56 of the socket 50 of the mating plug connector is not shown. The contact elements 56 of the socket 50 of the mating plug connector extend inwards in the radial direction to such an extent that when the plug connector and mating plug connector are plugged together, said contact elements deflect the bent-over portions 22 of the spring lugs 12 radially inwards. The resiliently elastic characteristics of the bent-over portions 22 of the spring lugs 12 thus bring about a corresponding contact pressure of these bent-over portions 22 against the contact elements 56, such that the desired electrical contact between the bent-over portions 22 and the contact elements 56 is established.

The spring lugs 12 or at least the bent-over portions 22 of the spring lugs 12 are made from phosphor bronze.

The insulating part 14 of the plug connector ensures that the distance between the signal conductors 10 even inside the plug connector in the area of the plugging interface corresponds to that distance in the cable 11, such that a signal transmission is ensured even inside the plug connector in the manner known for star quad cables. The arrangement of the bent-over portions 22 of the spring lugs 12 and the contact elements 56 allows greater tolerance compensation in the axial direction, such that the axial connection depth of the plug connector and mating plug connector is non-critical for the electrical quality or the signal transmission characteristics of the plug-connection. At the same time a long axial contacting length for the signal conductors of the star quad arrangement is obtained.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A plug connector for a cable including at least two signal conductors, said plug connector comprising a signal conductor part and an insulating part which holds the signal conductor part, wherein the plug connector has a plugging-side end for plug-connection to a complementary plug connector, and a cable-side end for electrical and mechanical connection to the cable, wherein the signal conductor part for each signal conductor includes a spring lug electrically and mechanically connected to a signal conductor, wherein the insulating part for each spring lug includes an axial hole through which a spring lug passes, wherein the holes hold the spring lugs at a physical distance from one another, this distance corresponding to the distance between the signal conductors in the cable, the spring lugs formed such that they are longer than the insulating part in the axial direction, and project beyond the insulating part at the plugging-side end and bent over such that the bent-over portions of the spring lugs run from the plugging-side end in the direction of the cable-side end and on an outer face of the insulating part can be resiliently elastically deformed in the radial direction.

2. The plug connector of claim 1, including a number of grooves on the insulating part outer face running in the axial direction corresponding to the number of spring lugs, wherein the grooves are arranged and formed such that in each case a bent-over portion of a spring lug is arranged in one of the grooves.

3. The plug connector of claim 1, wherein the holes in the insulating part hold the spring lugs in a spatial position which corresponds to the arrangement of the signal conductors relative to one another in the cable.

4. The plug connector of claim 1, wherein the spring lugs are crimped onto ends of the signal conductors of the cable.

5. The plug connector of claim 1, including a supporting sleeve which grips the cable at the cable-side end of the plug connector.

6. The plug connector according to claim 5, wherein the supporting sleeve is crimped onto the cable.

7. A plug connector arrangement comprising a plug connector and a complementary mating plug connector, wherein the plug connector is formed in accordance with claim 1 and the mating plug connector includes a number of contact elements corresponding to the number of spring lugs, such that the mating plug connector includes an insulating part in the form of a socket, the inner face of which is formed in a complementary manner to the outer face of the insulating part of the plug connector, the insulating part of the plug connector adapted for plugging axially into the socket of the mating plug connector, wherein the contact elements on the inner face of the socket of the mating plug connector are arranged in such a way that when the plug connector and mating plug connector are plugged together, each contact element of the mating plug connector is in electrical contact with a spring lug of the plug connector.

8. The connector arrangement of claim 7, wherein on its outer face the insulating part of the plug connector includes a number of grooves running in the axial direction corresponding to the number of spring lugs, the grooves receiving a bent-over portion of a spring lug, wherein the socket of the mating plug connector has radial ridges on its inner face which are arranged and formed in such a way that when the plug connector and mating plug connector are plugged together axially, each radial ridge engages in a groove on the outer face of the insulating part of the plug connector, wherein a contact element of the mating plug connector is arranged on each ridge of the socket.

9. The plug connector arrangement of claim 8, wherein the radial ridges of the socket of the mating plug connector are formed by the contact elements, arranged in grooves on the inner face of the socket of the mating plug connector.

10. The plug connector of claim 2, wherein the holes in the insulating part hold the spring lugs in a spatial position which corresponds to the arrangement of the signal conductors relative to one another in the cable.

11. The plug connector of claim 3, wherein the spring lugs are crimped onto ends of the signal conductors of the cable.

* * * * *